US007568739B2

(12) United States Patent
Lee

(10) Patent No.: US 7,568,739 B2
(45) Date of Patent: Aug. 4, 2009

(54) TOOL BOX HAVING A LOCKING MECHANISM

(76) Inventor: Yi-Min Lee, No. 62, Renmei Rd., Dali City, Taichung County (TW) 412

( * ) Notice: Subject to any disclaimer, the term of this patent is extended or adjusted under 35 U.S.C. 154(b) by 0 days.

(21) Appl. No.: 10/938,937

(22) Filed: Sep. 9, 2004

(65) Prior Publication Data

US 2006/0049640 A1 Mar. 9, 2006

(51) Int. Cl.
*E05C 19/06* (2006.01)

(52) U.S. Cl. ..... 292/80; 292/85; 292/247; 292/DIG. 48; 292/DIG. 49; 24/68 T; 24/71 T; 24/71 R; 220/324; 220/326

(58) Field of Classification Search ..... 292/80, 292/85, 247, DIG. 48, DIG. 49; 24/68 T, 24/71 SK, 71 R, 71 T; 220/315, 324, 326; 206/234

See application file for complete search history.

(56) References Cited

U.S. PATENT DOCUMENTS 2,602,685 A * 7/1952 Martinet et al. ..... 292/114
2,690,921 A * 10/1954 Braun ..... 292/113
2,829,912 A * 4/1958 Koch ..... 292/114
3,008,320 A * 11/1961 Tomkinson et al. ..... 70/74
3,030,137 A * 4/1962 Tomkinson et al. ..... 292/113
3,109,675 A * 11/1963 Anderson ..... 292/109
3,134,617 A * 5/1964 Slonneger ..... 292/3
3,706,467 A * 12/1972 Martin ..... 292/111
4,023,840 A * 5/1977 Souza et al. ..... 292/113
4,181,333 A * 1/1980 Stelma ..... 292/66
4,540,206 A * 9/1985 Frame et al. ..... 292/66
4,627,650 A * 12/1986 Hauschulte ..... 292/113
4,782,673 A * 11/1988 Castelli et al. ..... 70/72
5,127,684 A * 7/1992 Klotz et al. ..... 292/113
5,172,454 A * 12/1992 Martignago ..... 24/68 SK
5,461,892 A * 10/1995 Hsieh ..... 70/73
5,655,799 A * 8/1997 Takimoto ..... 292/113
5,667,258 A * 9/1997 Takimoto ..... 292/113
6,032,988 A * 3/2000 Klein ..... 292/247
6,217,835 B1 * 4/2001 Riley et al. ..... 422/297
6,257,631 B1 * 7/2001 Sokurenko et al. ..... 292/247
6,457,750 B1 * 10/2002 Sokurenko et al. ..... 292/113

FOREIGN PATENT DOCUMENTS

GB 382769 * 11/1932

* cited by examiner

*Primary Examiner*—Brian E. Glessner
*Assistant Examiner*—Carlos Lugo
(74) *Attorney, Agent, or Firm*—Banger Shia

(57) ABSTRACT

A tool box includes a first casing, a second casing, and a locking mechanism. The locking mechanism includes a locking unit, and a snapping unit. The locking unit includes a locking block. The snapping unit includes a seat, a pivot member, a snapping member, and two torsion springs. Thus, the locking mechanism is operated to open the tool box automatically, so that a user can open the tool box easily and conveniently, thereby facilitating the user operating the locking mechanism to open the tool box.

13 Claims, 6 Drawing Sheets

TOOL BOX HAVING A LOCKING MECHANISM

BACKGROUND OF THE INVENTION

1. Field of the Invention

The present invention relates to a tool box, and more particularly to a tool box having a locking mechanism.

2. Description of the Related Art

A conventional tool box comprises a main body formed with a snapping recess, and a cover pivotally mounted on the main body and formed with a snapping plate snapped into the snapping recess of the main body to lock the cover on the main body. However, the snapping plate of the cover is easily loosened from the snapping recess of the main body, so that the cover is not combined with the main body rigidly and stably, thereby greatly causing inconvenience to a user. In addition, the snapping plate of the cover is easily worn out during a long-term utilization, thereby decreasing the lifetime of the conventional tool box.

SUMMARY OF THE INVENTION

The primary objective of the present invention is to provide a tool box having a locking mechanism.

Another objective of the present invention is to provide a tool box, wherein the locking mechanism is operated to open the tool box automatically, so that a user can open the tool box easily and conveniently, thereby facilitating the user operating the locking mechanism to open the tool box.

A further objective of the present invention is to provide a tool box, wherein the snapping member of the snapping unit is detached from the locking block of the locking unit automatically, so that the user detaches the snapping unit from the locking unit easily and conveniently, thereby greatly facilitating the user detaching the first casing from the second casing so as to open the tool box.

In accordance with the present invention, there is provided a tool box, comprising a first casing, a second casing pivotally mounted on the first casing, and a locking mechanism mounted between the first casing and the second casing to combine the first casing and the second casing, wherein:

the locking mechanism includes a locking unit mounted on the second casing, and a snapping unit mounted on the first casing and detachably locked on the locking unit;

the locking unit of the locking mechanism includes a locking block mounted on a periphery of the second casing;

the snapping unit of the locking mechanism includes a seat mounted on a periphery of the first casing, a pivot member pivotally mounted on the seat, a snapping member having a first portion pivotally mounted on the pivot member and a second portion that is movable to lock the locking block of the locking unit, and two torsion springs each secured on the seat and each formed with two opposite urging bars urged on the snapping member.

Further benefits and advantages of the present invention will become apparent after a careful reading of the detailed description with appropriate reference to the accompanying drawings.

DETAILED DESCRIPTION OF THE INVENTION

Figure 1:
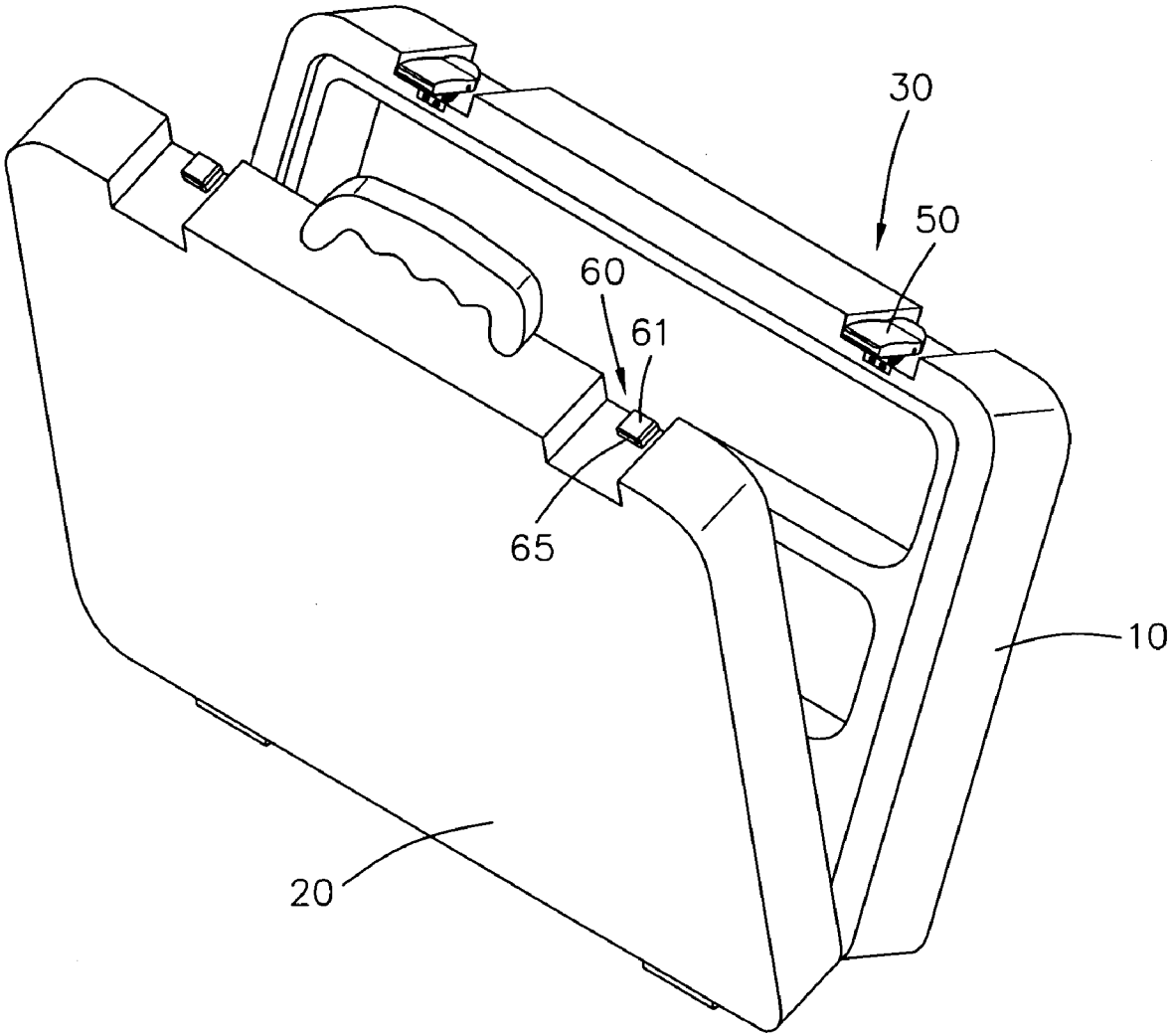
FIG. 1 is a perspective view of a tool box in accordance with the preferred embodiment of the present invention.
Figure 2:
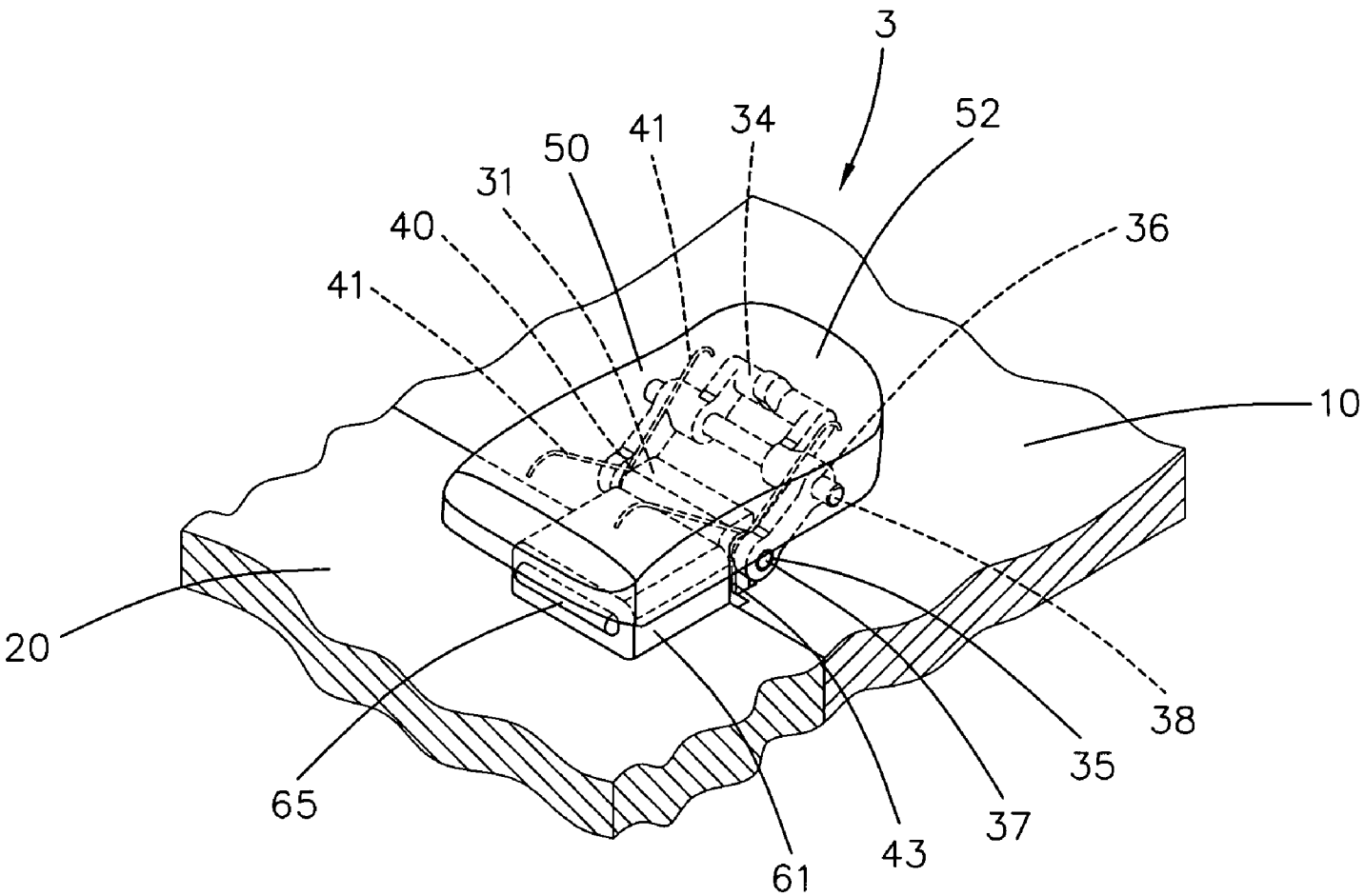
FIG. 2 is a partially perspective cross-sectional assembly view of the tool box as shown in FIG. 1.
Figure 3:
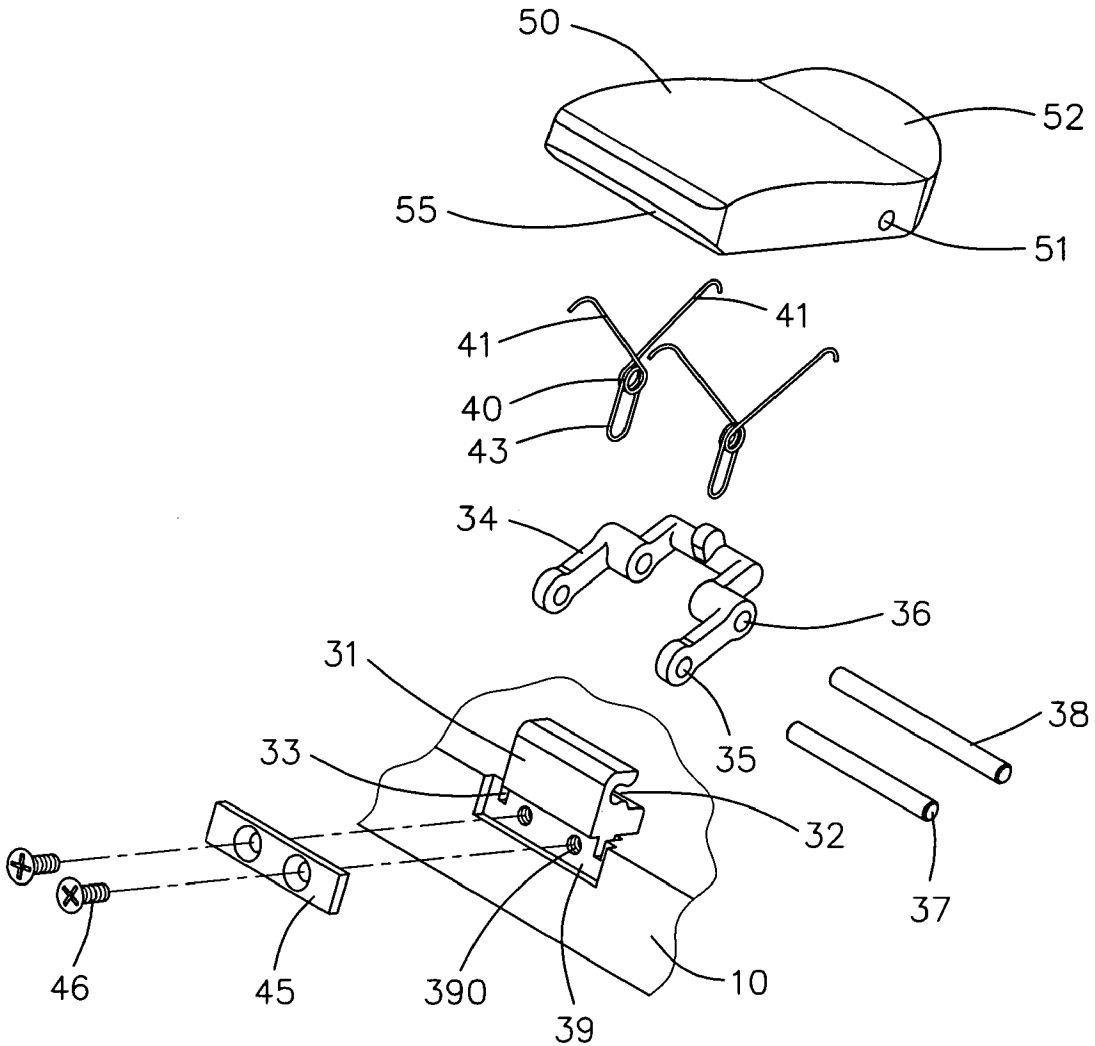
FIG. 3 is an exploded perspective view of the tool box as shown in FIG. 2.

Referring to the drawings and initially to FIGS. 1–4, a tool box in accordance with the preferred embodiment of the present invention comprises a first casing 10, a second casing 20 pivotally mounted on the first casing 10, and a locking mechanism 3 mounted between the first casing 10 and the second casing 20 to combine the first casing 10 and the second casing 20.

The locking mechanism 3 includes a locking unit 60 mounted on the second casing 20, and a snapping unit 30 mounted on the first casing 10 and detachably locked on the locking unit 60.

The locking unit 60 of the locking mechanism 3 includes a locking block 61 mounted on a periphery of the second casing 20 and having a side formed with a semi-circular protruding locking rib 65.

The snapping unit 30 of the locking mechanism 3 includes a seat 31 mounted on a periphery of the first casing 10, a pivot member 34 pivotally mounted on the seat 31, a snapping member 50 having a first portion pivotally mounted on the pivot member 34 and a second portion that is movable to lock the locking block 61 of the locking unit 60, and two torsion springs 40 each secured on the seat 31 and each formed with two opposite urging bars 41 urged on the snapping member 50.

The seat 31 of the snapping unit 30 has two ends each formed with two downward extended cutouts 33. The seat 31 of the snapping unit 30 has an end face formed with a mounting recess 39 formed with two screw bores 390. The seat 31 of the snapping unit 30 has a side formed with a substantially C-shaped pivot hole 32.

The pivot member 34 of the snapping unit 30 is substantially U-shaped and has two opposite sides each having a first end formed with a pivot hole 35 and a second end formed with a pivot bore 36.

A first pivot shaft 37 is extended through the pivot hole 35 of each of the two opposite sides of the pivot member 34, the two torsion springs 40 and the pivot hole 32 of the seat 31.

The snapping member 50 of the snapping unit 30 has a substantially inverted U-shaped cross-section and has two opposite sides each formed with a pivot bore 51. The first portion of the snapping member 50 of the snapping unit 30 is formed with a drive portion 52 extended upward in an oblique manner. The second portion of the snapping member 50 of the snapping unit 30 is formed with a hook-shaped snapping portion 55 that is movable to lock the locking rib 65 of the locking block 61 of the locking unit 60.

A second pivot shaft 38 is extended through the pivot bore 51 of each of the two opposite sides of the snapping member 50 and the pivot bore 36 of each of the two opposite sides of the pivot member 34.

The two urging bars 41 of each of the two torsion springs 40 of the snapping unit 30 have the same length and are extended outward along two opposite directions in an oblique manner. The two urging bars 41 of each of the two torsion springs 40 of the snapping unit 30 have top portions located at the same horizontal height, so that the snapping member 50 is disposed at a horizontal state by pressing of the two urging bars 41 of each of the two torsion springs 40. Each of the two torsion springs 40 of the snapping unit 30 is formed with a downward extended limit portion 43 secured in a respective one of the two cutouts 33 of the seat 31.

The snapping unit 30 of the locking mechanism 3 further includes a catch 45 mounted in the mounting recess 39 of the seat 31 to limit the limit portion 43 of each of the two torsion springs 40, so that each of the two torsion springs 40 is not rotated or displaced by an external force, and two locking screws 46 each extended through the catch 45 and each screwed into a respective one of the two screw bores 390 of the seat 31 to secure the catch 45 on the seat 31.

Figure 4:
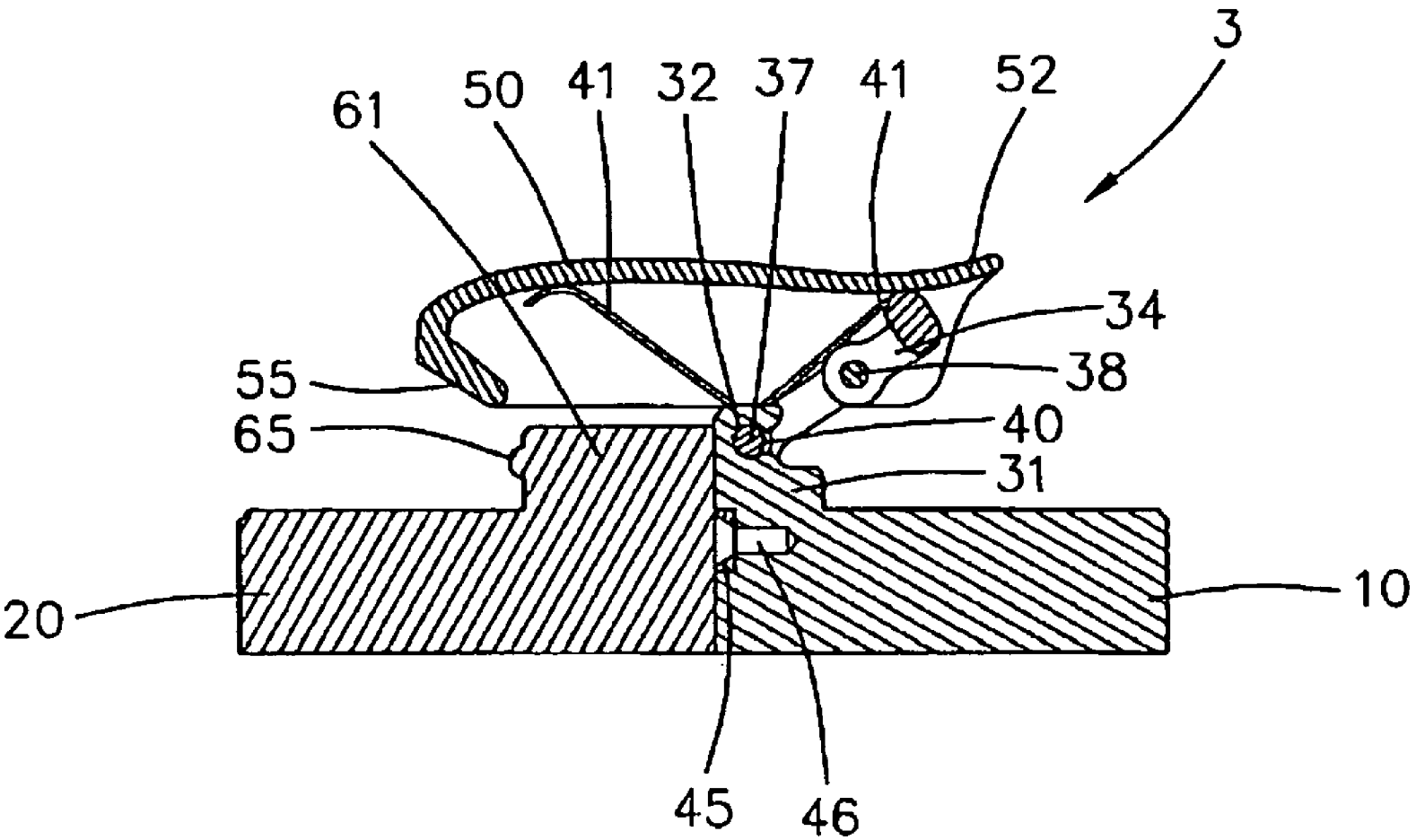
FIG. 4 is a plan cross-sectional view of the tool box as shown in FIG. 2.
Figure 5:
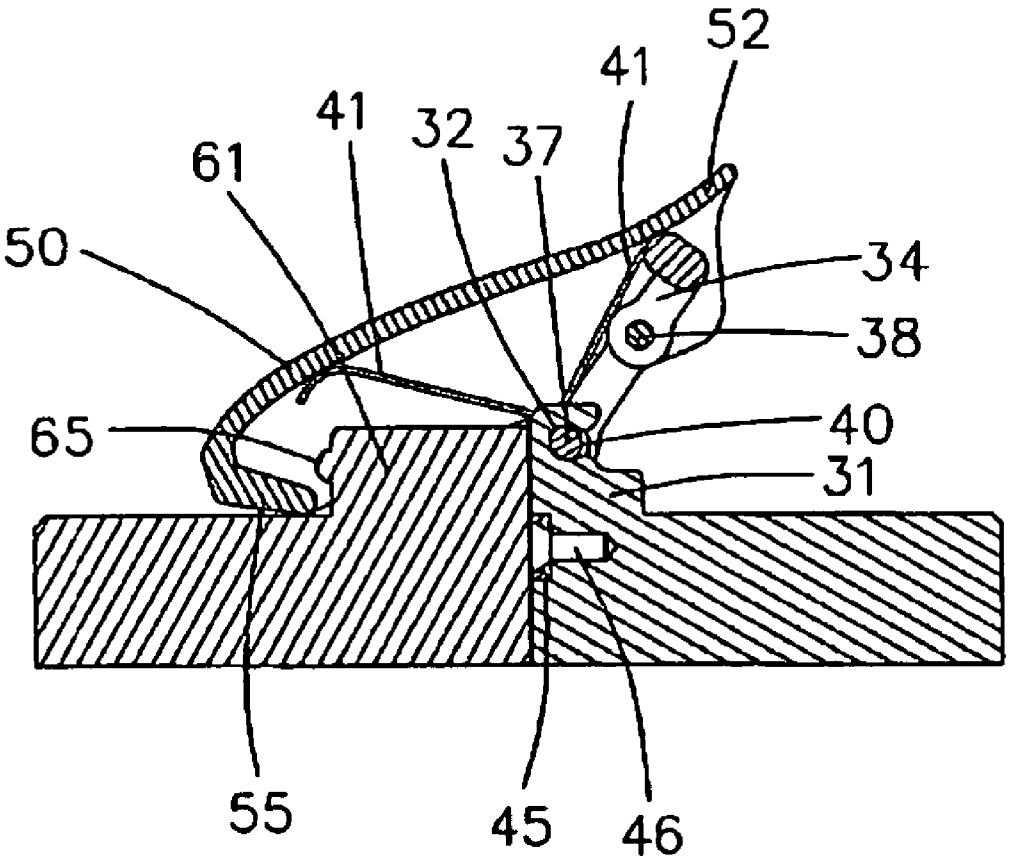
FIG. 5 is a schematic operational view of the tool box as shown in FIG. 4.
Figure 6:
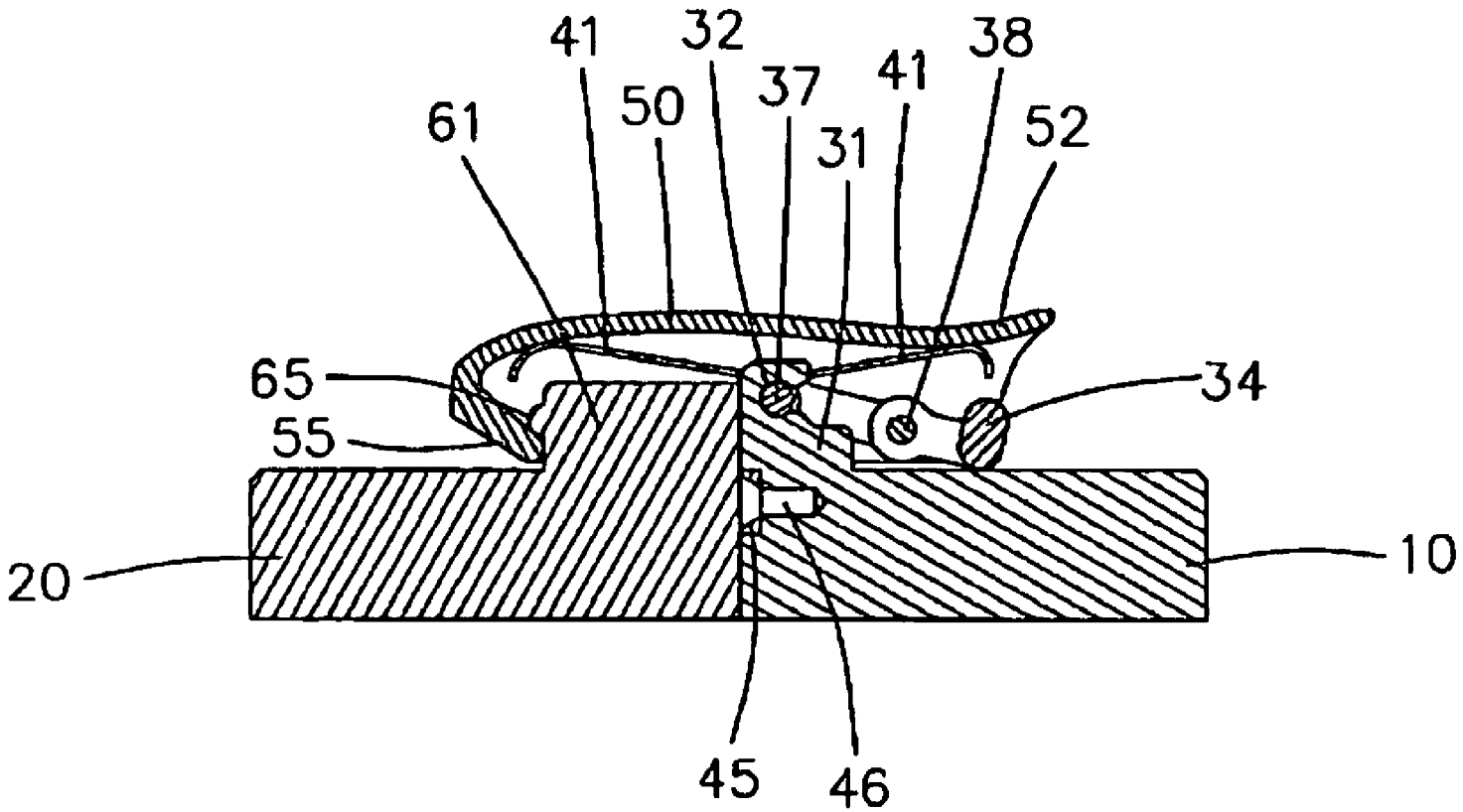
FIG. 6 is a schematic operational view of the tool box as shown in FIG. 5.

In operation, referring to FIGS. 1–6, the second portion of the snapping member 50 of the snapping unit 30 is pressed downward to move from the position as shown in FIG. 4 to the position as shown in FIG. 5, so that the snapping portion 55 of the snapping member 50 of the snapping unit 30 is snapped onto the locking rib 65 of the locking block 61 of the locking unit 60. Then, the drive portion 52 of the snapping member 50 of the snapping unit 30 is pressed downward to move from the position as shown in FIG. 5 to the position as shown in FIG. 6, so that the pivot member 34 is moved downward to lock the seat 31 by the dead corner of the pivot member 34. At this time, the snapping portion 55 of the snapping member 50 of the snapping unit 30 is closely locked on the locking rib 65 of the locking block 61 of the locking unit 60 as shown in FIG. 6, so that the snapping unit 30 is locked on the locking unit 60 so as to lock the first casing 10 and the second casing 20.

Alternatively, when the drive portion 52 of the snapping member 50 of the snapping unit 30 is pushed upward, the snapping member 50 is sprung upward by the restoring force of the two torsion springs 40, so that the snapping portion 55 of the snapping member 50 of the snapping unit 30 is detached from the locking rib 65 of the locking block 61 of the locking unit 60. At this time, the two urging bars 41 of each of the two torsion springs 40 of the snapping unit 30 have top portions located at the same horizontal height, so that the snapping member 50 is disposed at a horizontal state by pressing of the two urging bars 41 of each of the two torsion springs 40.

Accordingly, the snapping member 50 of the snapping unit 30 is detached from the locking block 61 of the locking unit 60 automatically, so that a user can detach the snapping unit 30 from the locking unit 60 easily and conveniently, thereby facilitating the user detaching the first casing 10 from the second casing 20 so as to open the tool box.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A tool box, comprising a first casing, a second casing pivotally mounted on the first casing, and a locking mechanism mounted between the first casing and the second casing to combine the first casing and the second casing, wherein:

the locking mechanism includes a locking unit mounted on the second casing, and a snapping unit mounted on the first casing and detachably locked on the locking unit;

the locking unit of the locking mechanism includes a locking block mounted on a periphery of the second casing;

the snapping unit of the locking mechanism includes a seat mounted on a periphery of the first casing, a pivot member pivotally mounted on the seat, a snapping member having a first portion pivotally mounted on the pivot member and a second portion that is movable to lock the locking block of the locking unit, and two torsion springs each secured on the seat and each formed with two opposite urging bars urged on the snapping member;

the seat of the snapping unit has two ends each formed with two downward extended cutouts, and each of the two torsion springs of the snapping unit is formed with a downward extended limit portion secured in a respective one of the two cutouts of the seat.

2. The tool box in accordance with claim 1, wherein the two urging bars of each of the two torsion springs of the snapping unit have the same length and are extended outward along two opposite directions in an oblique manner.

3. The tool box in accordance with claim 1, wherein the two urging bars of each of the two torsion springs of the snapping unit have top portions located at the same horizontal height, so that the snapping member is disposed at a horizontal state by pressing of the two urging bars of each of the two torsion springs.

4. The tool box in accordance with claim 1, wherein the locking block of the locking unit has a side formed with a protruding locking rib, and the second portion of the snapping member of the snapping unit is formed with a hook-shaped snapping portion that is movable to lock the locking rib of the locking block of the locking unit.

5. The tool box in accordance with claim 4, wherein the locking rib of the locking block of the locking unit is semi-circular.

6. The tool box in accordance with claim 1, wherein the seat of the snapping unit has an end face formed with a mounting recess, and the snapping unit of the locking mechanism further includes a catch mounted in the mounting recess of the seat to limit the limit portion of each of the two torsion springs, so that each of the two torsion springs is not rotated or displaced by an external force.

7. The tool box in accordance with claim 6, wherein the mounting recess of the seat is formed with two screw bores, and the snapping unit of the locking mechanism further includes two locking screws each extended through the catch and each screwed into a respective one of the two screw bores of the seat to secure the catch on the seat.

8. The tool box in accordance with claim 1, wherein the pivot member of the snapping unit is substantially U-shaped.

9. The tool box in accordance with claim 1, wherein the pivot member of the snapping unit has two opposite sides each having an end formed with a pivot bore, the snapping member of the snapping unit has two opposite sides each formed with a pivot bore, and the snapping unit of the locking mechanism further includes a pivot shaft extended through the pivot bore of each of the two opposite sides of the snapping member and the pivot bore of each of the two opposite sides of the pivot member.

10. The tool box in accordance with claim 9, wherein the snapping member of the snapping unit has a substantially inverted U-shaped cross-section.

11. The tool box in accordance with claim 1, wherein the first portion of the snapping member of the snapping unit is formed with a drive portion extended upward in an oblique manner.

12. A tool box, comprising a first casing, a second casing pivotally mounted on the first casing, and a locking mechanism mounted between the first casing and the second casing to combine the first casing and the second casing, wherein:

the locking mechanism includes a locking unit mounted on the second casing, and a snapping unit mounted on the first casing and detachably locked on the locking unit;

the locking unit of the locking mechanism includes a locking block mounted on a periphery of the second casing;

the snapping unit of the locking mechanism includes a seat mounted on a periphery of the first casing, a pivot member pivotally mounted on the seat, a snapping member having a first portion pivotally mounted on the pivot member and a second portion that is movable to lock the locking block of the locking unit, and two torsion springs each secured on the seat and each formed with two opposite urging bars urged on the snapping member;

the seat of the snapping unit has a side formed with a pivot hole, the pivot member of the snapping unit has two opposite sides each having an end formed with a pivot hole, and the snapping unit of the locking mechanism further includes a pivot shaft extended through the pivot hole of each of the two opposite sides of the pivot member, the two torsion springs and the pivot hole of the seat.

13. The tool box in accordance with claim 12, wherein the pivot hole of the seat is substantially C-shaped.

* * * * *